US005172989A

United States Patent [19]

Imaseki et al.

[11] Patent Number: 5,172,989

[45] Date of Patent: Dec. 22, 1992

[54] THERMAL TRANSFER COLOR PRINTER WITH TENSIONING ROLLER

[75] Inventors: Chiharu Imaseki, Yokohama; Masahiro Shiigi, Machida, both of Japan

[73] Assignee: Minolta Camera Kabushiki Kaisha, Osaka, Japan

[21] Appl. No.: 626,064

[22] Filed: Dec. 12, 1990

[30] Foreign Application Priority Data

Dec. 14, 1989 [JP] Japan ..... 1-324400
Dec. 14, 1989 [JP] Japan ..... 1-324401
Dec. 14, 1989 [JP] Japan ..... 1-324402

[51] Int. Cl.[5] ..... B41J 2/32; B41J 15/16; B65H 23/14

[52] U.S. Cl. ..... 400/120; 400/618; 400/641; 464/30; 242/75.2

[58] Field of Search ..... 400/120, 579, 618, 619, 400/641; 226/38, 39, 49; 346/76 PH, 136; 464/30, 34; 242/75, 75.1, 75.2, 75.3, 75.5

[56] References Cited

U.S. PATENT DOCUMENTS 4,505,603 3/1985 Yana ..... 400/120
4,532,525 7/1985 Takahashi ..... 400/120
4,567,492 1/1986 Skafvenstedt et al. ..... 400/579
4,642,656 2/1987 Shibuya et al. ..... 346/76 PH
4,943,812 7/1990 Yokoyama et al. ..... 346/1.1
4,962,389 10/1990 Kan et al. ..... 400/126
5,001,498 3/1991 Shimizu et al. ..... 400/120
5,021,804 6/1991 Nozawa et al. ..... 400/120

OTHER PUBLICATIONS

Manual of Classification, "Spraying", Dec. 1990.

*Primary Examiner*—Clifford D. Crowder
*Assistant Examiner*—Stephen R. Funk
*Attorney, Agent, or Firm*—Burns, Doane, Swecker & Mathis

[57] ABSTRACT

A thermal transfer color printer for recording color images on recording paper by successively transferring inks of different colors from an ink ribbon onto the recording paper at a recording position. The printer includes a transport member adapted to transport the recording paper in forward and reverse directions and disposed downstream from the platen roller with respect to the direction of transport of the recording paper for thermal transfer.

3 Claims, 4 Drawing Sheets

THERMAL TRANSFER COLOR PRINTER WITH TENSIONING ROLLER

BACKGROUND OF THE INVENTION

1. Field of the Invention

The present invention relates to thermal transfer color printers, and more particularly to a thermal transfer color printer for forming multicolor images by thermally transferring inks of different colors from an ink ribbon to recording paper a plurality of times.

2. Description of Related Art

Thermal transfer color printers are already known which are adapted for use with plain paper having specified surface smoothness and serving as a recording medium for transferring a sublimable dye or ink to the paper by a thermal head with application of pressure and heat. Such thermal transfer color printers are used also for producing color images.

These thermal transfer color printers include those adapted to produce color images by repeatedly transferring usually yellow, magenta and cyan inks in succession for each image to be eventually produced. (This type of printers will hereinafer be referred to as the "successive color transfer type.")

Generally in such thermal transfer color printers, recording paper is transported using a platen roller drivingly rotatable in forward and reverse directions as a standard for determining the amount of reciprocating transport of the paper. Various systems for transporting recording paper are also known which include, for example, a system wherein a tractor feeder is used for transporting fanfold paper serving as recording paper in combination with the platen roller as transport means.

However, these conventional thermal transfer color printers have the following problems. To ensure the intimate contact of the thermal head with the platen roller, the platen roller is made of an elastic material such as elastic rubber and is therefore difficult to form accurately in shape. The platen roller deforms on expansion due to the heat transferred from the thermal head. The platen roller as held out of transfer operation, i.e., out of contact with the thermal head, also deforms when brought into thermal transfer operation in pressing contact with the thermal head. If the platen roller is used as the standard for determining the amount of transport of the recording paper, a difference occurs between the amount of forward transport of the paper and that of reverse transport, with the result that the images of different colors which are thermally transferred onto the recording paper individually will not be in accurate register. The misregister of the transferred images (misregister of color impressions) gives rise to a problem in respect of the quality of copy images.

On the other hand, recording paper transport systems wherein different transport means are used as standards for forward and reverse directions are low in the accuracy of transport when reciprocatingly transporting the recording paper repeatedly. The poor accuracy, i.e., a difference between the amounts of forward and reverse transport, similarly poses a problem in respect of the quality of copy images since the images of different colors individually transferred onto the recording paper are out of register (misregister of colors).

SUMMARY OF THE INVENTION

The main object of the present invention is to provide an improved thermal transfer color printer which has overcome the foregoing problems.

Another object of the present invention is to provide a thermal transfer color printer adapted to prevent misregister of transferred images.

Another object of the present invention is to provide a thermal transfer color printer wherein variations in the speed of transport of recording paper are reduced.

Still another object of the present invention is to provide a thermal transfer color printer wherein the recording paper is prevented from skewing.

To accomplish the above objects, the present invention provides a thermal transfer color printer for recording color images on recording paper by successively transferring inks of different colors from an ink ribbon onto the recording paper at a recording position, the printer comprising a platen roller drivably rotatable and disposed at the recording position, a thermal head movable toward and away from the platen roller, and a transport member adapted to transport the recording paper in forward and reverse directions at the recording position and disposed downstream from the platen roller with respect to the direction of transport of the recording paper for thermal transfer.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

Figure 1:
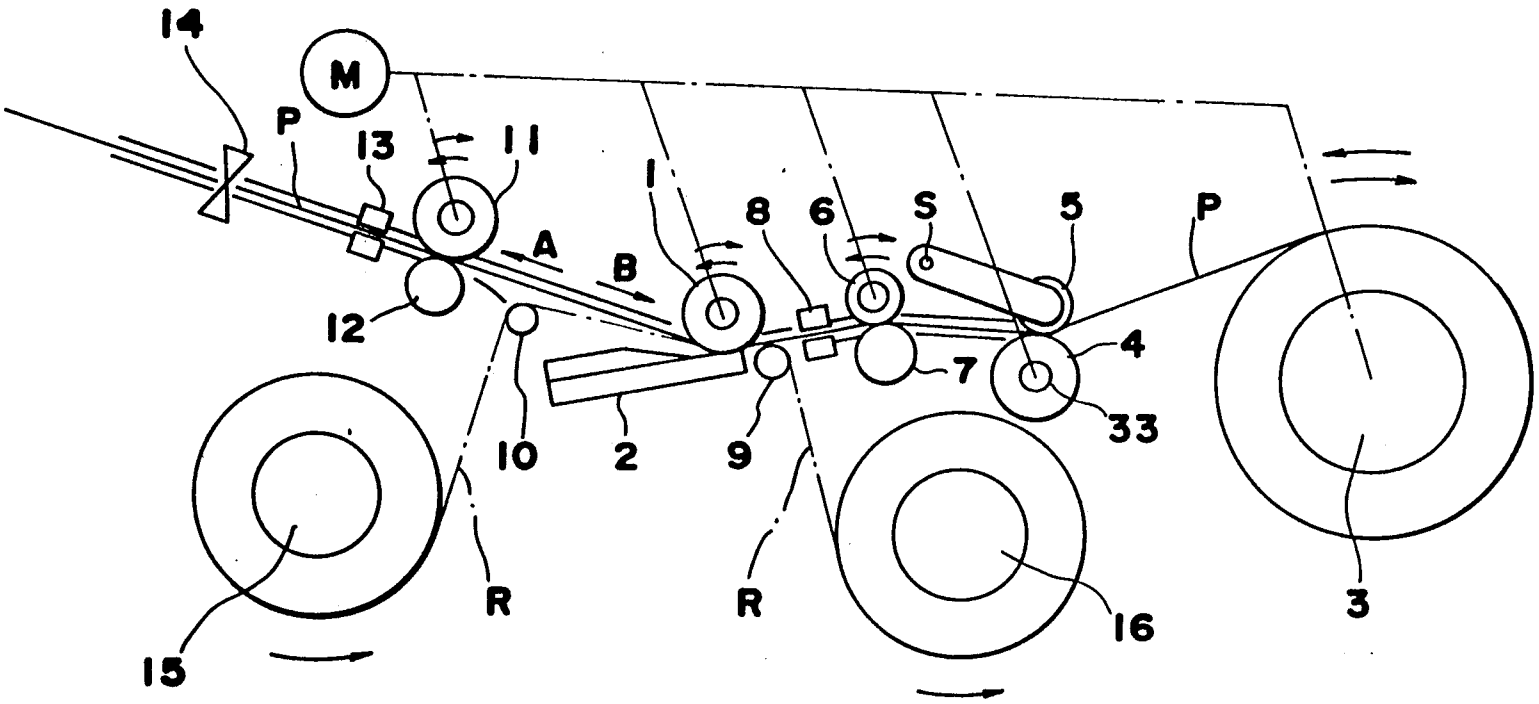
FIG. 1 is a front view schematically showing the construction of a thermal transfer color printer embodying the invention.

The present invention will be described below in detail with reference to the embodiment shown in the drawings.

The construction of the embodiment will be described first in the order of thermal transfer color printer, grip roller, platen roller and tension roller FIG. 1 is a front view schematically showing the construction of the embodiment of the invention. The thermal transfer color printer is of the successive color transfer type,.wherein a thermal head 2 is pressed against a platen roller 1 with recording paper P and an ink ribbon R transported to the roller 1 and interposed between the head 2 and the roller 1. The thermal head 2 is heated in accordance with image data for thermally transferring inks of different colors from the ink ribbon R to the recording paper P in succession to form a multicolor image.

The arrangement for this process will be described in detail. The platen roller 1 is disposed in the body of the printer centrally thereof. The thermal head 2 is opposed to the platen roller 1 and is movable into and out of pressing contact with the platen roller 1 with the recording paper P and the ink ribbon R interposed therebetween. A paper supply reel 3 is disposed at one end of the printer body and has wound thereon the recording paper P in the form of unused roll paper.

Arranged from the supply side of the paper P toward the discharge side thereof are the paper supply reel 3, a pay-off roller 4 and a feed roller 5 movable into pressing contact with the pay-off roller 4, a grip roller 6 and a driven roller 7 in pressing contact with the grip roller 6, a first paper sensor 8, a ribbon separating roller 9, the platen roller 1 and the thermal head 2 to be pressed against the platen roller 1 for thermal transfer, an ink ribbon guide roller 10 positioned at a small distance from a path of transport of the paper P, a tension roller 11 and a driven roller 12 in pressing contact with the tension roller 11, a second paper sensor 13, a cutter 14, etc. These members are arranged in the order mentioned to provide the path of transport of the recording paper P. The recording paper P is sent out along the path first in the direction of arrow A shown. Subsequently, the paper P is transported in the reverse direction of arrow B shown and the direction A repeatedly a plurality of times. When the paper P is returned by being transported in the reverse direction B, a color image is transferred to the paper. The paper is finally discharged in the direction A.

The ink ribbon R is in the form of a film sheet having approximately the same width as the recording paper P and is coated with solid inks of the thermally meltable pigment type or thermally sublimable dye type, each over a predetermined length, as arranged repeatedly in the order of three primary colors of yellow, magenta and cyan. The ink ribbon R, while in an unused state, is wound on an ink ribbon supply reel 15, paid off from this reel 15, guided by the ink ribbon guide roller 10, and led into a space between the platen roller 1 and the thermal head 2 along with the recording paper P. The portion of the ink ribbon R used for thermal transfer is separated from the recording paper P by the ribbon separating roller 9 and thereafter wound up on an ink ribbon take-up reel 16.

The thermal head 2 is pressed against the platen roller 1 for thermal transfer as illustrated and moved away from the roller 1 when brought out of thermal transfer operation. The top portion of the thermal head 2 is provided with a multiplicity of heat generating elements as aligned. The heat generating elements are individually energized selectively for heating in accordance with the image data delivered for each of the three primary colors, i.e., with the printing data for each monochromatic component.

The feed roller 5 is so supported as to be pivotally movable about a support point S downward into pressing contact with the pay-off roller 4 as illustrated, or upward away from the roller 4. The position of the feed roller 5 is detected by a sensor (not shown).

Next, the grip roller 6 will be described.

The grip roller 6 is disposed downstream from the platen roller 1 with respect to the direction B which is the direction of transport of the recording paper P during thermal transfer. The grip roller 6 is coupled to a paper transport motor M such as a pulse motor by a timing belt or the like and drivingly rotatable forward and reversely. The recording paper P is held between the grip roller 6 and the driven roller 7 and reciprocatingly transported in the directions A and B. To transport the paper P reliably with high accuracy free of slippage, the surface of the grip roller 6 is given a high coefficient of friction. Useful as the grip roller 6 is a metal roller having a roughened surface, a roller having fine ceramic particles applied to its surface by spray coating or adhesion, a rubber roller having a high coefficient of friction, or the like.

The grip roller 6 serves as the standard for determining the amount of transport of the recording paper P in the forward and reverse directions. With the present thermal transfer color printer, the grip roller 6 is set to the highest torque among other means providing the path of transport of the paper P and serves as the only standard for determining the amount of transport of the paper P in the directions A and B.

Next, the platen roller 1 will be described.

The platen roller 1 is rotatable by being driven by the recording paper P which is transported by the grip roller 6. The roller 1 is rotatable free of load clockwise in FIG. 1 but is driven with the load of a predetermined torque to rotate counterclockwise in the drawing. When the recording paper P is transported in the direction A, that is, when the paper P is merely transported without thermal transfer, the platen roller 1 is rotatable clockwise in the drawing completely freely, whereas when the paper is transported in the direction B, i.e., when the paper P is returned in the direction B for thermal transfer, the platen roller 1 is rotatable counterclockwise in the drawing. Since the platen roller 1 is loaded with the predetermined torque during rotation in the direction B, the roller 1 gives the paper P being transported tension (hereinafter referred to as "back tension") serving as a braking force.

Figure 2:
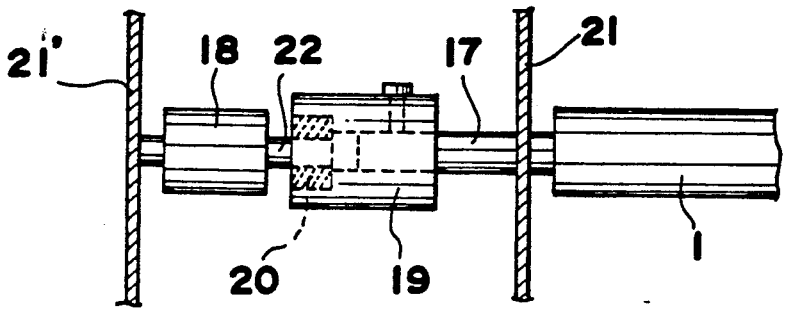
FIG. 2 is a side elevation in section showing an example of mount structure for a platen roller of the embodiment of the invention.
Figure 3:
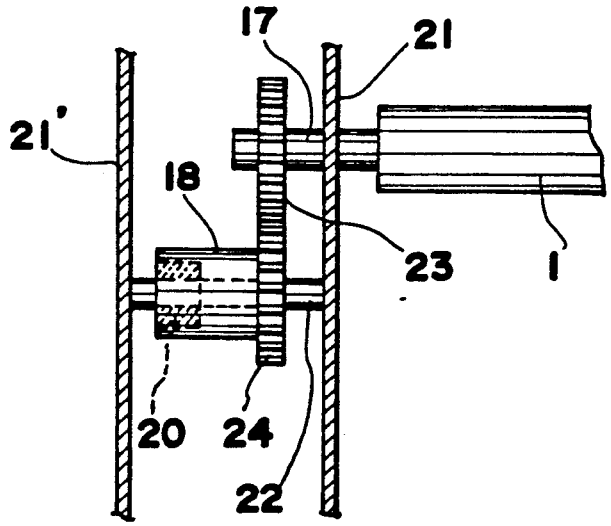
FIG. 3 is a side elevation in section showing another example of mount structure for the platen roller of the embodiment of the invention.

It appears useful to provide, for example, a torque limiter on the shaft of the platen roller 1 as means for giving tension by the load of predetermined torque. FIGS. 2 and 3 are side elevations in section showing mount structures for the platen roller 1 so adapted. FIG. 2 shows one example, and FIG. 3 another example.

In the example of FIG. 2, the shaft 17 of the platen roller 1 is connected to a torque limiter 18 coaxially therewith by a coupling 19, which has a one-way clutch 20 inside thereof. The shaft 17 of the platen roller 1 which is in the form of a drum has one end supported by a bearing on an inner side plate frame 21 and projecting outward beyond the frame. The torque limiter 18 of the predetermined torgue required for tensioning the recording paper P as stated above is secured to an outer side plate frame 21'. The end of the platen roller shaft 17 is connected to the shaft 22 of the torque limiter 18 coaxially therewith by the coupling 19. The one-way clutch 20 is provided inside the coupling 19.

First while the platen roller 1 is not in operation for thermal transfer, the one-way clutch 20 holds the platen roller shaft 17 disconnected from the torque limiter 18, rendering the platen roller 1 freely rotatable clockwise in FIG. 1 by the recording paper P transported in the direction A shown in the drawing. Conversely, during thermal transfer, the one-way clutch 20 holds the roller shaft 17 connected to the torque limiter 18, with the result that the platen roller 1 is loaded with the predetermined torque by the torque limiter 18 and rotated counterclockwise in FIG. 1 by the paper P transported in the direction B shown.

With the example of FIG. 3, the shaft 17 of the platen roller 1 is coupled to a torque limiter 18 by gears 23 and 24, and a one-way clutch 20 is provided inside the torque limiter 18. More specifically, the gear 23 is fixed to the platen roller shaft 17 at one end thereof supported by a bearing on an inner side plate frame 21 and projecting outward beyond the frame. The torque limiter 18 is attached to an outer side plate frame 21' by means of the one-way clutch 20 and has a shaft 22 supported by a bearing (not shown) on the inner side plate frame 21. The torque limiter shaft 22 fixedly carries the gear 24, which is in mesh with the gear 23. Alternatively, the torque limiter 18 may be fixed directly to the outer side plate frame 21', with the one-way clutch 20 provided inside the gear 23 or 24. The members shown in FIG. 3 each have the same function as the corresponding member already described with reference to FIG. 2.

Next, the tension roller 11 will be described.

The tension roller 11 is disposed upstream from the platen roller 1 with respect to the direction B which is the direction of transport of the paper P during thermal transfer. The roller 11 tensions the paper P to be transported.

Figure 4:
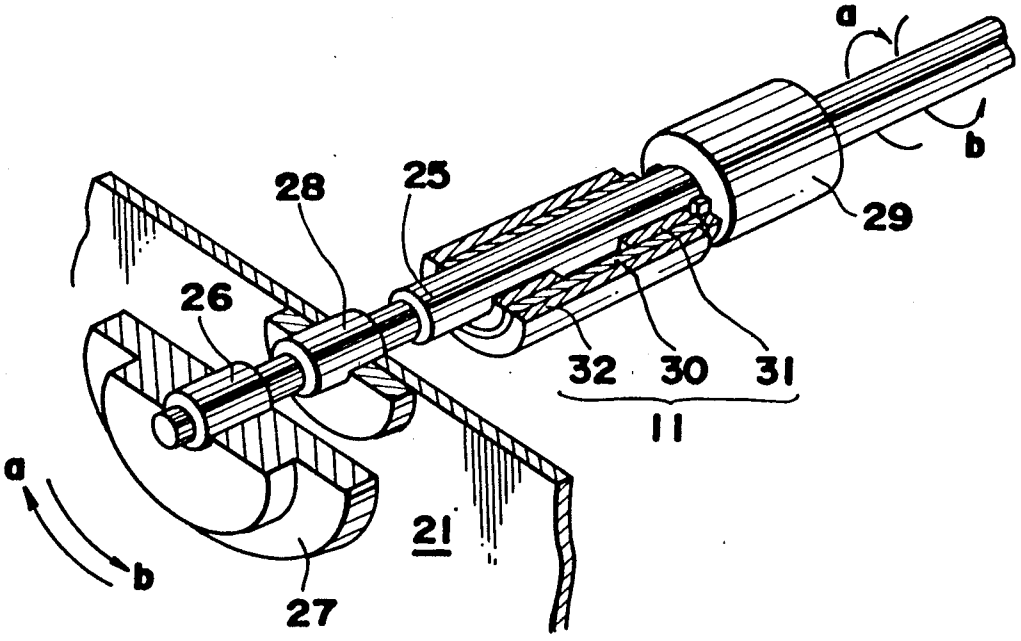
FIG. 4 is a perspective view partly in section and showing a mount structure for a tension roller of the embodiment of the invention.

The arrangement for giving tension will be described in greater detail. FIG. 4 is a perspective view partly broken away and showing a mount structure for the tension roller 11. Indicated at 25 is a drive shaft, one end of which extends outward through the side plate frame 21 and has a drive gear 27 attached thereto by a one-way clutch 26. The drive gear 27 is coupled to the above-mentioned paper transport motor M. Another one-way clutch 28 is provided between the drive shaft 25 and a shaft mount portion of the side plate frame 21.

The tension roller 11 is connected to the drive shaft 25 by an annular torque limiter 29. More specifically, the torque limiter 29 has one end, i.e., an inner peripheral portion, secured to the drive shaft 25 and an outer member which is the other end serving as a torque output end. The tension roller 11 comprises a bearing member 31 as an inner layer and a rubber member 32 as an outer layer, with a core member 30 interposed therebetween. The core member 30 has one end secured to the torque limiter 29 and is rotatable relative to the drive shaft 25 extending through the bearing member 31.

Figure 5:
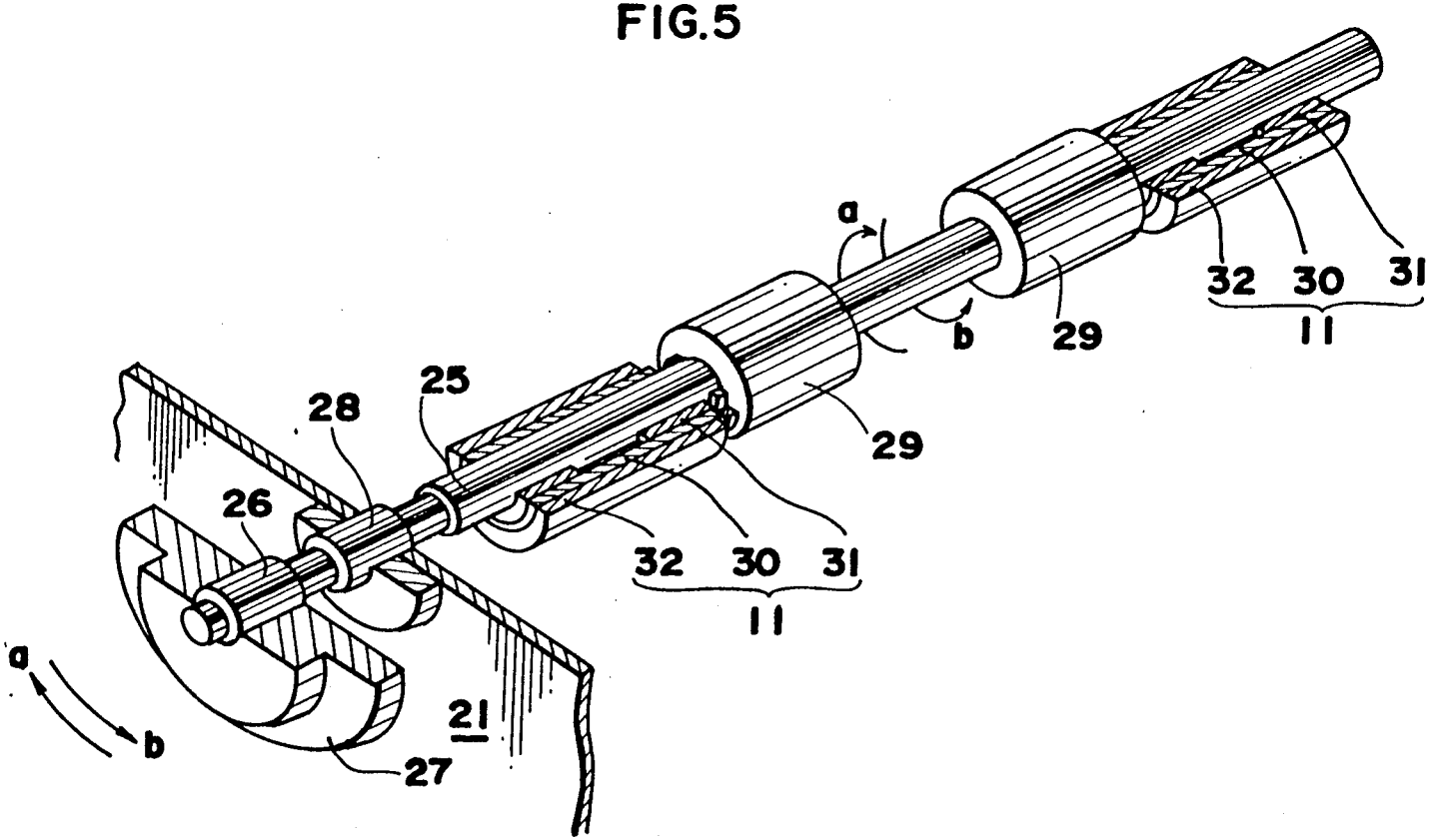
FIG. 5 is a perspective view partly in section and showing a mount structure for two tension rollers for use in the embodiment of the invention.

FIG. 5 is a perspective view partly broken away and showing a mount structure for two tension rollers 11 like the one described above. These tension rollers 11 are arranged in the axial direction, i.e., widthwise of the recording paper P and give tension to the paper P equivalently but independently of each other. With the example of FIG. 5, two torque limiters 29 having the same load are mounted on the midportion of the drive shaft 25 and spaced apart by a specified distance. The two tension rollers 11 are connected to the drive shaft 25 by the respective torque limiters 29 individually, one on each side of the drive shaft 25. The other members shown in FIG. 5 are the same as the corresponding members of FIG. 4 in construction, etc., so that like parts are designated by like reference numerals and will not be described again. While only two tension rollers 11 are provided on opposite sides in the example of FIG. 5, three, four or more tension rollers 11 may be provided.

The function of the tension roller 11 will be described next.

The tension roller 11 gives tension to the recording paper P in the following manner when the paper P is transported in the direction A (see FIG. 1) without thermal transfer.

The drive gear 27 is driven by the paper transport motor M clockwise, i.e. in a direction a, as illustrated to rotate the drive shaft 25 in the direction a, with the drive gear 27 connected to the drive shaft 25 by the one-way clutch 26. The one-way clutch 28 holds the shaft mount portion of the side plate frame 21 disconnected from the drive shaft 25 and functions merely as a bearing. The rotation of the drive shaft 25 is transmitted to the tension roller 11 via the torque limiter 29, which therefore delivers the rotation with a specified low torque. The tension roller 11 which is driven in the direction a gives predetermined tension to the paper P. The specified torque to be given by the torque limiter 29, i.e., the tension to be given by the tension roller 11, is such that the recording paper P being transported as nipped between the grip roller 6 and the driven roller 7 as described above is thereby prevented from slackening, and is not so high as to permit slippage of the paper P at the nip of the grip roller 6 and the driven roller 7. Incidentally, the tension roller 11 is set to a peripheral speed which is slightly higher than that of the grip roller 6.

On the other hand, the tension roller 11 gives back tension to the recording paper P in the following manner during thermal transfer, that is, during the transport of the paper P in the direction B (see FIG. 1).

The paper transport motor M drives the drive gear 27 counterclockwise, i.e., in a direction b, as illustrated, whereas since the drive gear 27 is disconnected from the drive shaft 25 by the one-way clutch 26, the rotation of the drive gear 27 is not transmitted to the drive shaft 25. On the other hand, the shaft mount portion of the side plate frame 21 is connected to the drive shaft 25 by the one-way clutch 28, so that the drive shaft 25 is locked with respect to the direction b, failing to rotate in this direction. Since the drive shaft 25 is thus locked, the torque limiter 29 limits to a predetermined value the torque of the tension roller 11 which is rotated with the transport of the paper P in the direction B. Consequently, although rotatable in the direction b, the tension roller 11 has the predetermined torque to give the paper P being transported back tension acting as a braking force.

In this way, the tension roller 11 tensions the recording paper P to be transported in the directions A and B. The paper supply reel 3 is free to rotate in the counterclockwise feed direction in FIG. 1 when the recording paper P is transported in the direction A without thermal transfer, while the reel 3 is drivingly rotated in the clockwise winding direction in FIG. 1 with a low torque determined so as not to slacken the paper P when the paper P is transported in the direction B for thermal transfer.

The operation of the thermal transfer color printer will be described below.

The printer sequentially executes the following (1) setting step, (2) thermal transfer step, (3) paper discharge step and (4) preparation step, and thereafter repeats these steps in the order of (2), (3), (4), (2), (3), . . .

(1) Setting step

First, recording paper P is loaded on the paper supply reel 3. The feed roller 5 is lifted away from the pay-off roller 4. The leading end of the recording paper P is placed on the pay-off roller 4. The feed roller 5 is lowered into pressing contact with the pay-off roller 4 with the leading end of the paper P positioned therebetween. A sequential operation is then initiated which includes feed of the paper P and positioning of the leading end of an ink ribbon R in place.

Stated more specifically, the paper transport motor M drives the pay-off roller 4, the grip roller 6 and the tension roller 11. The recording paper P is paid off from the supply reel 3, passed around the platen roller 1 and further transported along the path of transport in the direction A. After the pay-off roller 4 has been driven counterclockwise in FIG. 1 for a predetermined period of time, a clutch 33 on the drive shaft of the roller 4 interrupts the transmission of the drive force to render the roller 4 free to rotate. In the meantime, the paper supply reel 3 and the platen roller 1 are rotatable respectively in the counterclockwise direction and clockwise direction in the drawing. The tension roller 11 is driven clockwise in the drawing with the specified low torque, tensioning the paper P being transported as nipped between the roller 11 and the driven roller 12 to prevent slackening.

In this way, the recording paper P is transported as held between the grip roller 6 and the driven roller 7 accurately by a predetermined length, with the grip roller 6 serving as the sole standard for the amount of transport. For example, when A4 size is to be used for thermal transfer, the leading end of the paper P is transported to and stopped at the position at a distance of 420 mm from the transfer position of the platen roller 1 toward the direction A by controlling the rotation of the grip roller 6, i.e., the paper transport motor M.

The ink ribbon R is paid off from the ink ribbon supply reel 15 and halted upon the yellow ink reaching the transfer position.

(2) Thermal transfer step

When a print command is given, the first color of yellow is thermally transferred to the paper P first.

More specifically, the thermal head 2 is pressed against the platen roller 1 with the ink ribbon R and the paper P held therebetween, and the paper supply reel 3 and the grip roller 6 are driven clockwise and counterclockwise, respectively, whereby the paper P is transported along the transport path in the direction B. At the same time, the ink ribbon R is also transported with the paper P in intimate contact therewith. The heat generating elements on the thermal head 2 are selectively energized for heating based on the printing data for a monochromatic component, i.e., for yellow, only to thermally transfer the yellow ink from the ink ribbon R to the recording paper P. The paper supply reel 3 is driven clockwise in FIG. 1 with the predetermined torque to prevent the paper P from slackening. Although rotatable counterclockwise, the platen roller 1 and the tension roller 11 each have the predetermined torque, giving the paper P being transported back tension acting as a braking force to prevent the paper P from slackening.

The grip roller 6 serves as the sole standard for the amount of transport of the recording paper P when the paper P is transported in the direction B for thermal transfer as when it is transported in the direction A without thermal transfer. Because the grip roller 6 driven counterclockwise has a highly frictional surface, the paper P can be transported as held between the grip roller 6 and the driven roller 7 accurately by a predetermined length. Thus, by controlling the rotation of the grip roller 6, i.e., the paper transport motor M, the recording paper P is transported in the direction B by a distance corresponding to the sum of the printing area or printing length which is dependent on the presence or absence of printing data and the separation distance of travel from the platen roller 1 to the ribbon separating roller 9.

After the first color yellow has been completely transferred, the thermal head 2 is released and moved away from the platen roller 1. The portion of the ink ribbon R used is passed around the separating roller 9, separated from the recording paper P, sent forward and wound on the ink ribbon take-up reel 16.

Subsequently, the second color of magenta is thermally transferred onto the paper P. First, the paper P is transported in the direction A and stopped, and the magenta ink portion of the ink ribbon R is brought to the transfer position as in the setting step (1). The second color magenta is then transferred while the paper P is being returned toward the direction B in the same manner as described above. The thermal transfer of the third color cyan thereafter follows similarly.

(3) Paper discharge step

When the thermal head 2 is moved away from the platen roller 1 upon the completion of transfer of the third color cyan, the recording paper P is positioned as transported reversely in the direction B. For the discharge of the paper P, therefore, the paper P is transported in the direction A as in the foregoing setting step (1) and cut. More specifically, when the leading end of the paper P is transported from the position of the cutter 14 in the direction A by a specified length, for example, to the position at a distance of 420 mm from the cutter 14 in the case where A3 size is used for thermal transfer, the rotation of the grip roller 6 is stopped, and the cutter 14 is driven to cut the paper P to A3 size.

(4) Preparation step

When the paper P has been cut by the cutter 14, the recording paper P is transported for the subsequent transfer operation by the rotation of the grip roller 6 to bring the paper leading end, for example, to the position at a distance of 420 mm from the transfer position of the platen roller 1, whereby the paper P is set in a standby state.

Thus, the thermal transfer color printer executes the foregoing sequence of (1) setting step, (2) thermal transfer step, (3) paper discharge step and (4) preparation step to thermally transfer the inks of different colors from the ink ribbon R onto a specified area of the recording paper P in succession as superimposed thereon. In this way, multicolor images are formed on the paper P from area to area.

The thermal transfer color printer is adapted to prevent the misregister of colors by the following features.

The grip roller 6 serves as the standard for the amount of reciprocating transport of the recording paper P, and the platen roller 1 merely follows the transport of the paper P although the platen roller 1 is deformed by the thermal head 2 which is pressed against and moved away from the platen roller 1. This eliminates the difference that would occur between the amounts of forward and reverse transport of the recording paper P if the platen roller 1 is used as the standard for the amount of transport. Furthermore, the grip roller 6 is free of expansion or deformation due to the heat from the thermal head 2. Additionally, since the grip roller 6 serves as the sole standard for the amount of reciprocating transport of the recording paper P, the paper P can be transported accurately free from the adverse influence of other transport means even if reciprocatingly transported a number of times repeatedly. The tension roller 11 further reliably prevents the recording paper P from slackening, ensuring transport of the paper P to the transfer position free of errors.

The thermal transfer color printer has a wider range of thermal transfer as described below.

Although the platen roller 1 is freely rotatable when the recording paper P is returned in the direction B for thermal transfer, the rotation of the roller 1 involves the load of predetermined torque provided by the torque limiter 18 (see FIGS. 1 and 2) and therefore gives slight back tension to the paper P being transported in the direction B. In the later stage of the thermal transfer operation for each color, the end of the paper P (the rear end with respect to the direction B or the leading end with respect to the direction A) is released from the tension roller 11 toward the direction B. If the transfer operation further continues, for example, if the contemplated printing area or length extends over the entire area of A4 size, the following situation will be encountered.

Suppose the platen roller 1 has no load of predetermined torque and is completely free to rotate in this case. The transport of the paper P in the direction B will then be adversely affected, for example, by variations in the winding load on the ink ribbon R or by variations in the speed of rotation of the platen roller 1 due to the inertia of the roller itself, consequently permitting color misregister over an area close to the paper end released from the tension roller 11. To avoid this trouble, there arises a need to reduce the range of thermal transfer or printing by excluding from this range the paper end area which corresponds to the distance from the transfer position of the platen roller 1 to the tension roller 11.

With the present thermal transfer color printer, however, the platen roller 1 gives the recording paper P back tension to inhibit the adverse effects due to various variation factors and the like to preclude occurrence of color misregister on the paper P in the vicinity of its end.

Further with the thermal transfer color printer, the recording paper P is prevented from skewing in the following manner.

When a plurality of tension rollers 11 are provided as arranged axially of the shaft as already described as in the example of FIG. 5 wherein two rollers 11 are used, the tension rollers 11 tension the recording paper P equivalently and independently of each other. Accordingly, for example even if the tension rollers 11 are positioned somewhat inaccurately, these rollers 11 independently give tension to the paper P uniformly over the width thereof to prevent the paper P from skewing.

Other features

The thermal transfer color printer is adapted to mechanically preclude color misregister as described above.

For the platen roller 1 or the tension roller 11, a mechanical rotation control system is used which comprises the combination of torque limiter 18 and one-way clutch 20 or the combination of torque limiter 29 and one-way clutches 26, 28 as shown in FIGS. 2 and 3, or FIGS. 4 and 5. Any electric rotation control system is used which includes a microcomputer, electromagnetic clutch or the like.

Further with the thermal transfer color printer, the path of transport extends almost straight. This also serves to prevent color misregister and jams.

With reference to FIG. 1, the path of transport of the recording paper P is almost horizontal and linear and includes no U-shaped curve. First, this reduces the amount of the paper P wound around the platen roller 1 in pressing contact therewith, i.e., the amount of bend of the paper P in the vicinity of the platen roller 1, with the corresponding result that the paper P can be transported without slackening to preclude color misregister. The straight transport path naturally prevents the recording paper P also from jamming the path.

Furthermore, the thermal transfer color printer uses roll paper as the recording paper P as shown in FIG. 1 and employs a return printing system wherein the inks are thermally transferred to the paper P during the return of the paper in the direction B. The system therefore enlarges the transfer or printing range on the recording paper P. However, the present invention is not limited to this system. If the transfer or printing range need not be so enlarged, cut paper may be used in place of the roll paper as the recording paper P, and a paper cassette in place of the supply reel 3 so as to supply the cut paper from the cassette. Of course, the cutter 14 is unnecessary in this case.

The thermal transfer color printer further comprises a so-called full-color system. The ink ribbon R is coated with inks of three primary colors, yellow, magenta and cyan, which are thermally transferred to the recording paper P to form multicolor images. Nevertheless, the present invention is not limited to this system but can of course be embodied as a system which employs, for example, an ink ribbon R coated with inks of two colors and wherein these color inks are thermally transferred to recording paper.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A thermal transfer color printer for recording color images on recording paper by successively transferring inks of different colors from an ink film onto the recording paper at a recording position, the printer comprising:

a rotatable platen roller disposed at the recording position;

a thermal head for heating the ink film and transferring the ink from the ink film onto the recording paper, said thermal head pressing the recording paper and the ink film against the platen roller at the recording position;

transport means, disposed downstream from the platen roller with respect to a direction of transport of the recording paper during thermal transfer, for transporting the recording paper in a forward direction and a reverse direction at the recording position; and tension means, disposed upstream from the platen roller with respect to the direction of transport of the recording paper during thermal transfer, for providing a predetermined tension to the recording paper, said tension means including a roller provided on an axle, a torque limiter disposed between the axle and the roller, and a one-way clutch disposed between the axle and a member connected to a power supply.

2. A thermal transfer color printer according to claim 1 wherein said axle is supported on a frame of a main assembly through a one-way clutch.

3. A thermal transfer color printer according to claim 1 wherein the roller, the torque limiter and the one-way clutch are disposed between the axle of the tension roller and the member connected to a power supply.

* * * * *